US009505211B2

(12) United States Patent
Fujii et al.

(10) Patent No.: US 9,505,211 B2
(45) Date of Patent: Nov. 29, 2016

(54) SEMICONDUCTOR DEVICE, LIQUID DISCHARGE HEAD, LIQUID DISCHARGE CARTRIDGE, AND LIQUID DISCHARGE APPARATUS

(71) Applicant: CANON KABUSHIKI KAISHA, Tokyo (JP)

(72) Inventors: Kazunari Fujii, Tokyo (JP); Masanobu Ohmura, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/662,380

(22) Filed: Mar. 19, 2015

(65) Prior Publication Data

US 2015/0283807 A1 Oct. 8, 2015

(30) Foreign Application Priority Data

Apr. 2, 2014 (JP) ..... 2014-076461
Dec. 3, 2014 (JP) ..... 2014-245172

(51) Int. Cl.
*B41J 2/045* (2006.01)
*B41J 2/14* (2006.01)

(52) U.S. Cl.
CPC ..... *B41J 2/04541* (2013.01); *B41J 2/0455* (2013.01); *B41J 2/0458* (2013.01); *B41J 2/14072* (2013.01)

(58) Field of Classification Search
CPC B41J 2/04543; B41J 2/0455; B41J 2/04541; B41J 2/0458; B41J 2/14072
See application file for complete search history.

(56) References Cited

U.S. PATENT DOCUMENTS 6,629,757 B1 10/2003 Sugioka et al. ..... 347/71
2010/0134543 A1* 6/2010 Hirayama ..... B41J 2/04541 347/10
2011/0175959 A1 7/2011 Van Brocklin et al. ..... 347/14

* cited by examiner

*Primary Examiner* — Geoffrey Mruk
(74) *Attorney, Agent, or Firm* — Fitzpatrick, Cella, Harper & Scinto

(57) ABSTRACT

A semiconductor device for a liquid discharge head is provided. The device includes first and second electrodes, discharge elements configured to give energy to a liquid, first switching elements configured to electrically connect first terminals of discharge elements to the first electrode, and including one or more first switching elements each connected to two or more discharge elements, and second switching elements configured to electrically connect second terminals of the plurality of discharge elements to the second electrode, and including one or more second switching element each connected to two or more discharge elements. Two or more discharge elements connected to a same second switching element are connected to different first switching elements.

18 Claims, 10 Drawing Sheets

SEMICONDUCTOR DEVICE, LIQUID DISCHARGE HEAD, LIQUID DISCHARGE CARTRIDGE, AND LIQUID DISCHARGE APPARATUS

BACKGROUND OF THE INVENTION

Field of the Invention

The present invention relates to a semiconductor device, liquid discharge head, liquid discharge cartridge, and liquid discharge apparatus.

Description of the Related Art

A liquid discharge head using thermal energy selectively causes a bubbling phenomenon in a liquid by giving thermal energy generated by a heating element to the liquid, and discharges ink from an orifice by the energy of bubbling. In a semiconductor device for a liquid discharge head described US2011/0175959A, switching elements are connected to the two ends of a heating element, and an electric current is supplied to the heating element by turning on the two switching elements. When it is unnecessary to supply any electric current to the heating element, both the switching elements connected to the two ends of the heating element are turned off. This suppresses an unnecessary voltage from being applied to the heating element.

SUMMARY OF THE INVENTION

In the semiconductor device disclosed in US2011/0175959A, a plurality of heating elements share one switching element on the power supply voltage side, and a switching element is connected to each heating element on the ground side. Therefore, the number of switching elements used in this semiconductor device is larger than that of heating elements. When the number of switching elements increases, the chip area of the semiconductor device also increases. This problem applies to general semiconductor devices including not only the heating element but also another discharge element such as a piezoelectric element. An aspect of the present invention provides a technique for downsizing a semiconductor device in which switching elements are arranged on the two sides of a discharge element.

According to some embodiments, a semiconductor device for a liquid discharge head is provided. The device includes a first electrode configured to supply a first voltage; a second electrode configured to supply a second voltage different from the first voltage; a plurality of discharge elements configured to give energy to a liquid, each discharge element including a first terminal and a second terminal; a plurality of first switching elements configured to electrically connect the first terminals of the plurality of discharge elements to the first electrode, and including one or more first switching elements each connected to two or more discharge elements; and a plurality of second switching elements configured to electrically connect the second terminals of the plurality of discharge elements to the second electrode, and including one or more second switching element each connected to two or more discharge elements. Two or more discharge elements connected to a same second switching element are connected to different first switching elements.

According to some other embodiments, a semiconductor device for a liquid discharge head, comprises a first electrode configured to supply a first voltage; a second electrode configured to supply a second voltage different from the first voltage; and a plurality of blocks, each including a plurality of discharge elements configured to give energy to a liquid, each discharge element including a first terminal and a second terminal; a plurality of first switching elements configured to electrically connect the first terminals of the plurality of discharge elements to the first electrode, and including one or more first switching elements each connected to two or more discharge elements; and a plurality of second switching elements configured to electrically connect the second terminals of the plurality of discharge elements to the second electrode, and including one or more second switching element each connected to two or more discharge elements. In each of the plurality of blocks, two or more discharge elements connected to a same second switching element are connected to different first switching elements.

Further features of the present invention will become apparent from the following description of exemplary embodiments (with reference to the attached drawings).

DESCRIPTION OF THE EMBODIMENTS

Figure 1:
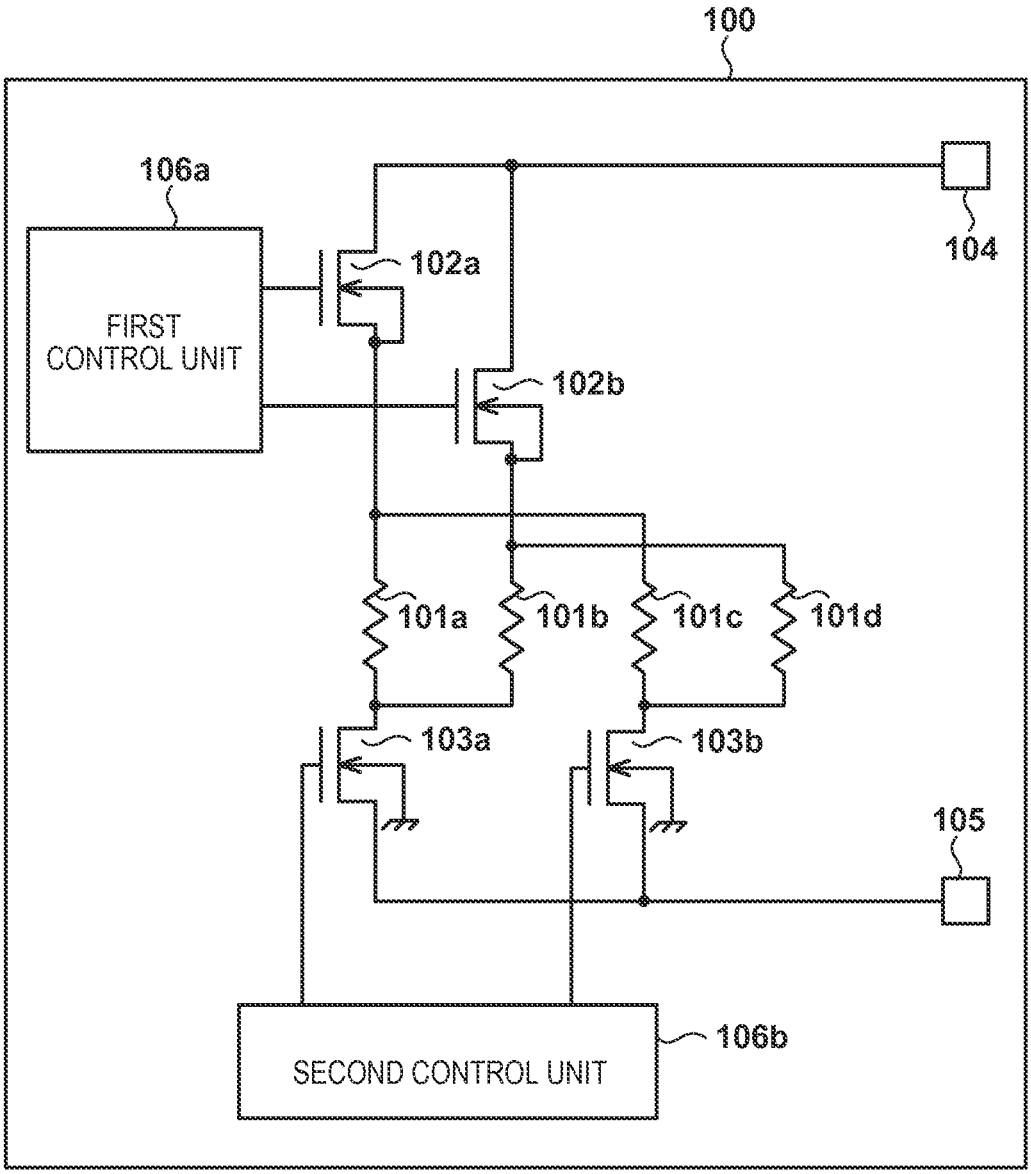
FIG. 1 is an equivalent circuit diagram of a semiconductor device according to some embodiments.

Embodiments of the present invention will be explained below with reference to the accompanying drawings. In these embodiments, the same reference numerals denote the same elements, and a repetitive explanation will be omitted. Also, these embodiments can be changed and combined as needed. An embodiment of the present invention relates to a semiconductor device for a liquid discharge head for discharging a liquid such as ink.

An arrangement example of a semiconductor device 100 according to some embodiments will be explained with reference to an equivalent circuit diagram of FIG. 1. The semiconductor device 100 includes a plurality of heating elements 101*a* to 101*d*, a plurality of first switching elements 102*a* and 102*b*, a plurality of second switching elements 103*a* and 103*b*, a power supply electrode 104, a ground electrode 105, a first control unit 106*a*, and a second control unit 106*b*. These constituent elements are formed on a semiconductor substrate or the like. In the following explanation, the plurality of heating elements 101*a* to 101*d* will generally be called a heating element 101. An explanation of the heating element 101 applies to any of the plurality of heating elements 101*a* to 101*d*. Likewise, the plurality of first switching elements 102*a* and 102*b* will generally be called a first switching element 102, and the plurality of second switching elements 103*a* and 103*b* will generally be called a second switching element 103.

The heating element 101 (a heater) generates heat in accordance with an electric current flowing through the heating element 101. This thermal energy is given to a liquid, and the liquid is discharged from an orifice. The heating element 101 is formed by a heating resistor or the like. Instead of the heating element 101, it is also possible to use another discharge element capable of giving energy to a liquid when driven. An example of the other discharge element is a piezoelectric element. In the following explanation, one end (the upper end in FIG. 1) of the heating element 101 will be called a first terminal, and the other end (the lower end in FIG. 1) will be called a second terminal. The heating element 101 generates heat when an electric current flows between the first and second terminals.

The first terminal of the heating element 101 is electrically connected to the power supply electrode 104 by the first switching element 102. More specifically, the first terminal of the heating element 101 and the power supply electrode 104 are electrically connected when the first switching element 102 is turned on, and the first terminal of the heating element 101 and the power supply electrode 104 are opened when the first switching element 102 is turned off. A power supply voltage is supplied to the power supply electrode 104 from outside the semiconductor device 100.

The first switching element 102 is formed by, for example, an NMOS transistor. In this case, the source of the NMOS transistor as the first switching element 102 is connected to the first terminal of the heating element 101, the drain is connected to the power supply electrode 104, and the back gate is connected to the source. The first control unit 106*a* supplies a control signal to the gate (control terminal) of the NMOS transistor. The first switching element 102 may also be formed by a PMOS transistor or another circuit element which functions as a switching element, instead of the NMOS transistor.

The second terminal of the heating element 101 is electrically connected to the ground electrode 105 by the second switching element 103. More specifically, the second terminal of the heating element 101 and the ground electrode 105 are electrically connected when the second switching element 103 is turned on, and the second terminal of the heating element 101 and the ground electrode 105 are opened when the second switching element 103 is turned off. A ground voltage is supplied to the ground electrode 105 from outside the semiconductor device 100.

The second switching element 103 is formed by, for example, an NMOS transistor. In this case, the source of the NMOS transistor as the second switching element 103 is connected to the ground electrode 105, the drain is connected to the second terminal of the heating element 101, and the back gate is grounded. The second control unit 106*b* supplies a control signal to the gate (control terminal) of the NMOS transistor. The second switching element 103 may also be formed by a PMOS transistor or another circuit element which functions as a switching element, instead of the NMOS transistor.

When the power supply voltage to be supplied to the power supply electrode 104 is, for example, 30 V, a voltage to be supplied to the gate of the first switching element 102 in order to turn it on is, for example, 28 V, and a voltage to be supplied to the gate of the second switching element 103 in order to turn it on is, for example, 5 V. Since the first control unit 106*a* must supply a high-voltage control signal, the first control unit 106*a* includes a logic circuit for generating control signals to be supplied to the first switching elements 102*a* and 102*b*, and a level conversion circuit for converting an output signal from this logic circuit into a high voltage. On the other hand, the second control unit 106*b* need only supply a logic-power-level control signal, so the second control unit 106*b* includes a logic circuit for generating control signals to be supplied to the second switching elements 103*a* and 103*b*, but need not include any level conversion circuit.

The connection configuration of the heating element 101, first switching element 102, and second switching element 103 will be explained in detail below. The heating element 101*a* is connected to the first switching element 102*a* and second switching element 103*a*. The heating element 101*b* is connected to the first switching element 102*b* and second switching element 103*a*. The heating element 101*c* is connected to the first switching element 102*a* and second switching element 103*b*. The heating element 101*d* is connected to the first switching element 102*b* and second switching element 103*b*. Thus, a plurality of heating elements 101 connected to the same second switching element 103 are connected to different first switching elements 102. Since the semiconductor device 100 has this connection configuration, it is possible to supply an electric current to only one heating element 101 and supply no electric current to other heating elements 101 by properly selecting and turning on a set of the first and second switching elements 102 and 103. For example, when the first switching element 102*a* and second switching element 103*a* are turned on and other switching elements are turned off, an electric current flows through only the heating element 101*a* and does not flow through other heating elements.

Also, the first switching element 102*a* is connected to two heating elements 101*a* and 101*c*. The first switching element 102*b* is connected to two heating elements 101*b* and 101*d*. The second switching element 103*a* is connected to two heating elements 101*a* and 101*b*. The second switching element 103*b* is connected to two heating elements 101*c* and 101*d*. Thus, each first switching element 102 is connected to two heating elements 101, and each second switching element 103 is connected to two heating elements 101. The number of switching elements included in the semiconductor device 100 can be reduced when a plurality of heating elements 101 share one first switching element 102 on the side of the power supply electrode 104, and a plurality of heating elements 101 share one second switching element 103 on the side of the ground electrode 105. The number of switching elements included in the semiconductor device 100 (the sum of the number of first switching elements 102 and the number of second switching elements 103) is four, and equal to the number of heating elements 101. The semiconductor device 100 can be downsized because the number of switching elements can be reduced as described above.

Figure 2:
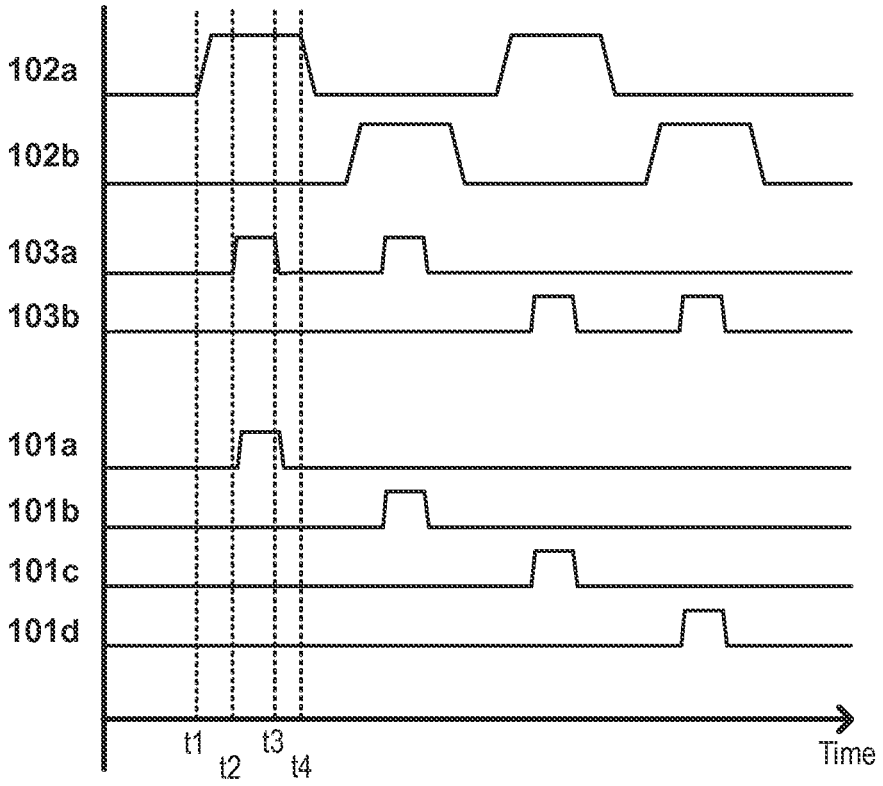
FIG. 2 is a timing chart for explaining the operation of the semiconductor device shown in FIG. 1.

Next, an operation example of the semiconductor device 100, particularly, an operation example of the control unit 106 will be explained with reference to a timing chart shown in FIG. 2. In this operation example of the semiconductor device 100, the power supply voltage is supplied to the power supply electrode 104, and the ground voltage is supplied to the ground electrode 105. The abscissa of FIG. 2 represents time. The ordinate of FIG. 2 represents the voltage value of a control signal to be supplied to the gate of each of the first switching elements 102*a* and 102*b* and second switching elements 103*a* and 103*b*, and represents the value of an electric current which flows through each of the heating elements 101*a* to 101*d*. The semiconductor device 100 supplies an electric current to the heating elements 101*a* to 101*d* in this order. The control unit 106 may also generate control signals shown in FIG. 2 based on signals supplied from outside the semiconductor device 100.

At time t1, the first control unit 106*a* switches a control signal to be supplied to the first switching element 102*a* from Low level to High level. Consequently, the first switching element 102*a* is turned on. While the first switching element 102*a* is ON, at time t2, the second control unit 106*b* switches a control signal to be supplied to the second switching element 103*a* from Low level to High level. Consequently, the second switching element 103*a* is turned on, and an electric current flows through the heating element 101*a*. While the first switching element 102*a* is ON, at time t3, the second control unit 106*b* switches the control signal to be supplied to the second switching element 103*a* from High level to Low level. Accordingly, the second switching element 103*a* is turned off, and no electric current flows through the heating element 101*a* any longer. At time t4, the first control unit 106*a* switches the control signal to be supplied to the first switching element 102*a* from High level to Low level. As a consequence, the first switching element 102*a* is turned off. The ON width (ON duration) of the first switching element 102 is, for example, a few μs, and that of the second switching element 103 is, for example, a few ten to a few hundred ns.

After that, as shown in FIG. 2, the control unit 106 appropriately switches ON/OFF of the first switching element 102 and second switching element 103, thereby supplying an electric current to the heating elements 101*b* to 101*d* in this order.

The High-level voltage value (for example, 28 V) of the control signal to be supplied to the first switching element 102 is higher than the High-level voltage value (for example, 5 V) of the control signal to be supplied to the second switching element 103. Accordingly, the time during which the control signal to be supplied to the first switching element 102 switches from Low level to High level is longer than the time during which the control signal to be supplied to the second switching element 103 switches from Low level to High level. As described above, therefore, the control unit 106 switches ON/OFF of the second switching element 103 while the first switching element 102 is ON. By this operation, an electric current flowing through the heating element 101 is controlled by ON/OFF of the second switching element 103, so the heating element 101 can be driven at high speed. The rise time and fall time of the control signal to be supplied to the first switching element 102 have no influence on the rise time and fall time of the electric current flowing through the heating element 101. This makes it unnecessary to rapidly change this control signal. Accordingly, it is possible to simplify the circuit configuration of the first control unit 106*a*, and reduce the generation of noise by rapidly changing the high voltage.

Figure 3A:
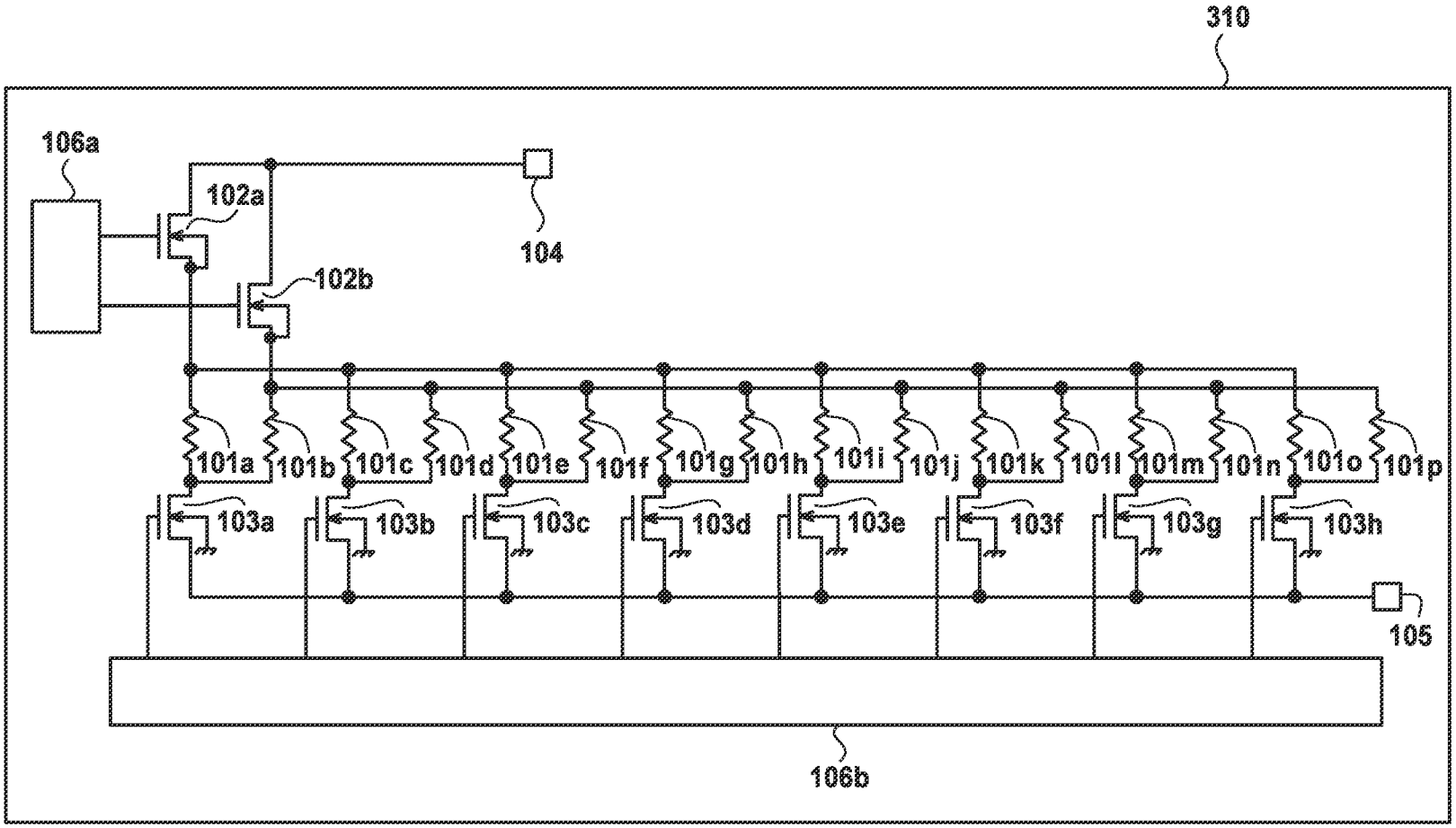
FIGS. 3A and 3B are equivalent circuit diagrams of semiconductor devices according to some embodiments.
Figure 3B:
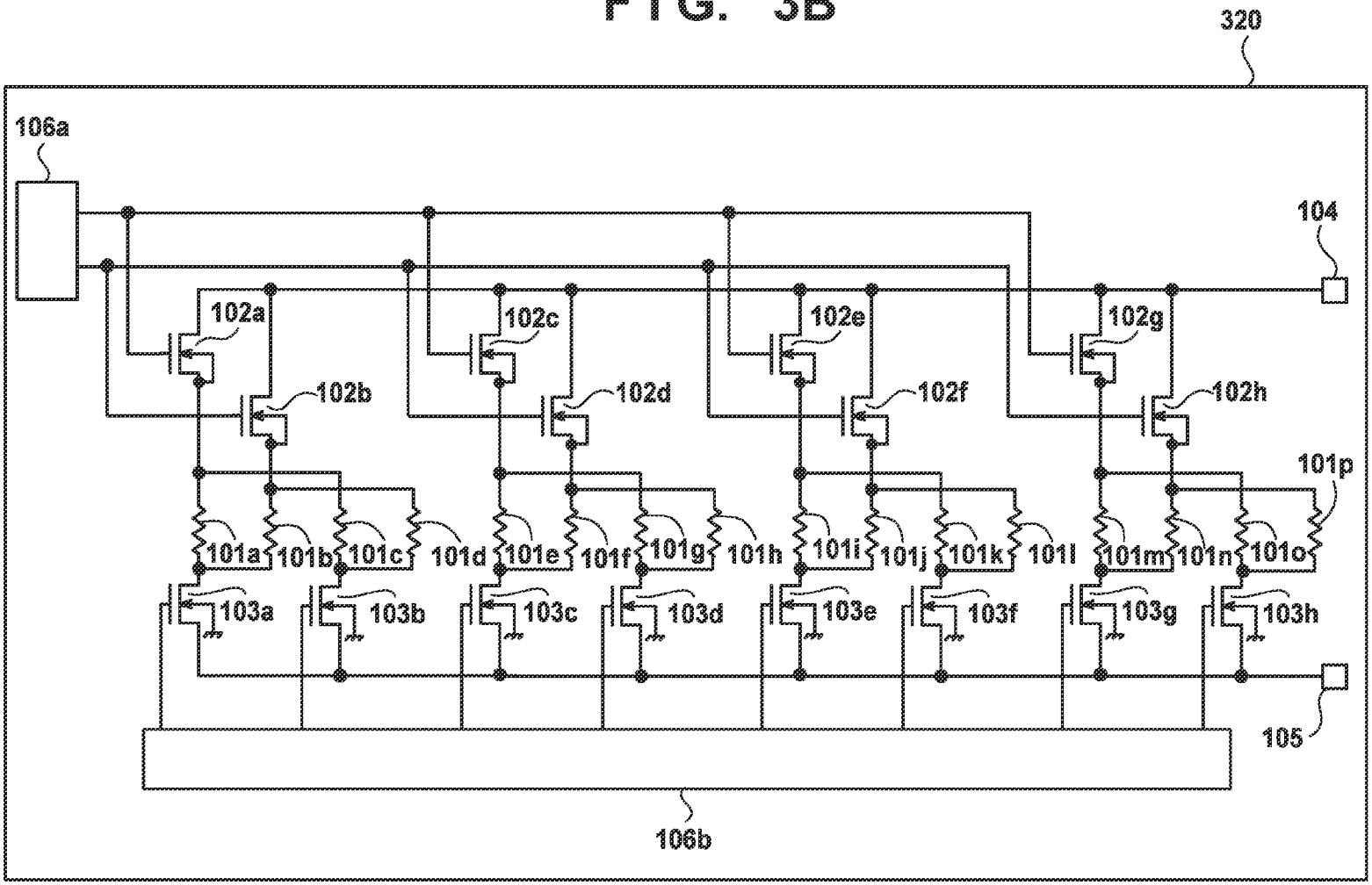

Arrangement examples of semiconductor devices according to some other embodiments will be explained below with reference to equivalent circuit diagrams shown in FIGS. 3A and 3B. In FIGS. 3A and 3B, the same reference numerals as in the semiconductor device 100 shown in FIG. 1 denote the same constituent elements, and a repetitive explanation will be omitted. A semiconductor device 310 shown in FIG. 3A includes a plurality of heating elements 101*a* to 101*p*, a plurality of first switching elements 102*a* and 102*b*, a plurality of second switching elements 103*a* to 103*h*, a power supply electrode 104, a ground electrode 105, a first control unit 106*a*, and a second control unit 106*b*. These constituent elements are formed on a semiconductor substrate or the like. As in the semiconductor device 100, the plurality of heating elements 101*a* to 101*p* will generally be called a heating element 101, the plurality of first switching elements 102*a* and 102*b* will generally be called a first switching element 102, and the plurality of second switching elements 103*a* to 103*h* will generally be called a second switching element 103.

Two or more heating elements 101 connected to the same second switching element 103 are connected to different first switching elements 102 in the semiconductor device 310 as well. Therefore, it is possible to supply an electric current to only one heating element 101 and supply no electric current to other heating elements 101 by properly selecting and turning on a set of the first and second switching elements 102 and 103 in the semiconductor device 310 as well.

Also, in the semiconductor device 310, each first switching element 102 is connected to eight heating elements 101, and each second switching element 103 is connected to two heating elements 101. Accordingly, the number of switching elements can be reduced in the semiconductor device 310 as well. The number of switching elements included in the semiconductor device 100 (the sum of the number of first switching elements 102 and the number of second switching elements 103) is 10, and is smaller than the number (16) of heating elements 101.

In the semiconductor device 310, the number (2) of first switching elements 102 is smaller than the number (8) of second switching elements 103. In this case, the second switching elements 103 are arranged more densely than the first switching elements 102. Therefore, the plurality of heating elements 101 and the plurality of second switching elements 103 may also be connected such that a plurality of heating elements 101 connected to one second switching element 103 are adjacent to each other. For example, two heating elements 101*a* and 101*b* connected to the second switching element 103*a* are adjacent to each other. This layout facilitates connecting the heating elements 101 and second switching elements 103, and can further downsize the semiconductor device 310.

A semiconductor device 320 shown in FIG. 3B includes a plurality of heating elements 101*a* to 101*p*, a plurality of first switching elements 102*a* to 102*h*, a plurality of second switching elements 103*a* to 103*h*, a power supply electrode 104, a ground electrode 105, a first control unit 106*a*, and a second control unit 106*b*. These constituent elements are formed on a semiconductor substrate or the like. As in the semiconductor device 100, the plurality of heating elements 101*a* to 101*p* will generally be called a heating element 101, the plurality of first switching elements 102*a* to 102*h* will generally be called a first switching element 102, and the plurality of second switching elements 103*a* to 103*h* will generally be called a second switching element 103. The semiconductor device 320 has the same arrangement and effects as the semiconductor device 100.

In the semiconductor device 320, the first control unit 106*a* supplies the same control signal (that is, a control signal which switches Low level and High level at the same timing) to a plurality of first switching elements 102, thereby controlling these first switching elements in synchronism with each other. For example, the first control unit 106*a* supplies the same control signal to four first switching elements 102*a*, 102*c*, 102*e*, and 102*g*, and supplies the same control signal to four first switching elements 102*b*, 102*d*, 102*f*, and 102*h*. In the semiconductor device 320, a plurality of first switching elements to which the same control signal is supplied are connected to different heating elements 101, so the control unit 106 can individually drive a plurality of heating elements 101.

The semiconductor device 320 can be regarded as including four blocks each having four heating elements 101 and two first switching elements 102 and two second switching elements 103 connected to the four heating elements 101. In this case, the first control unit 106*a* supplies a common control signal set to each block.

Figure 4:
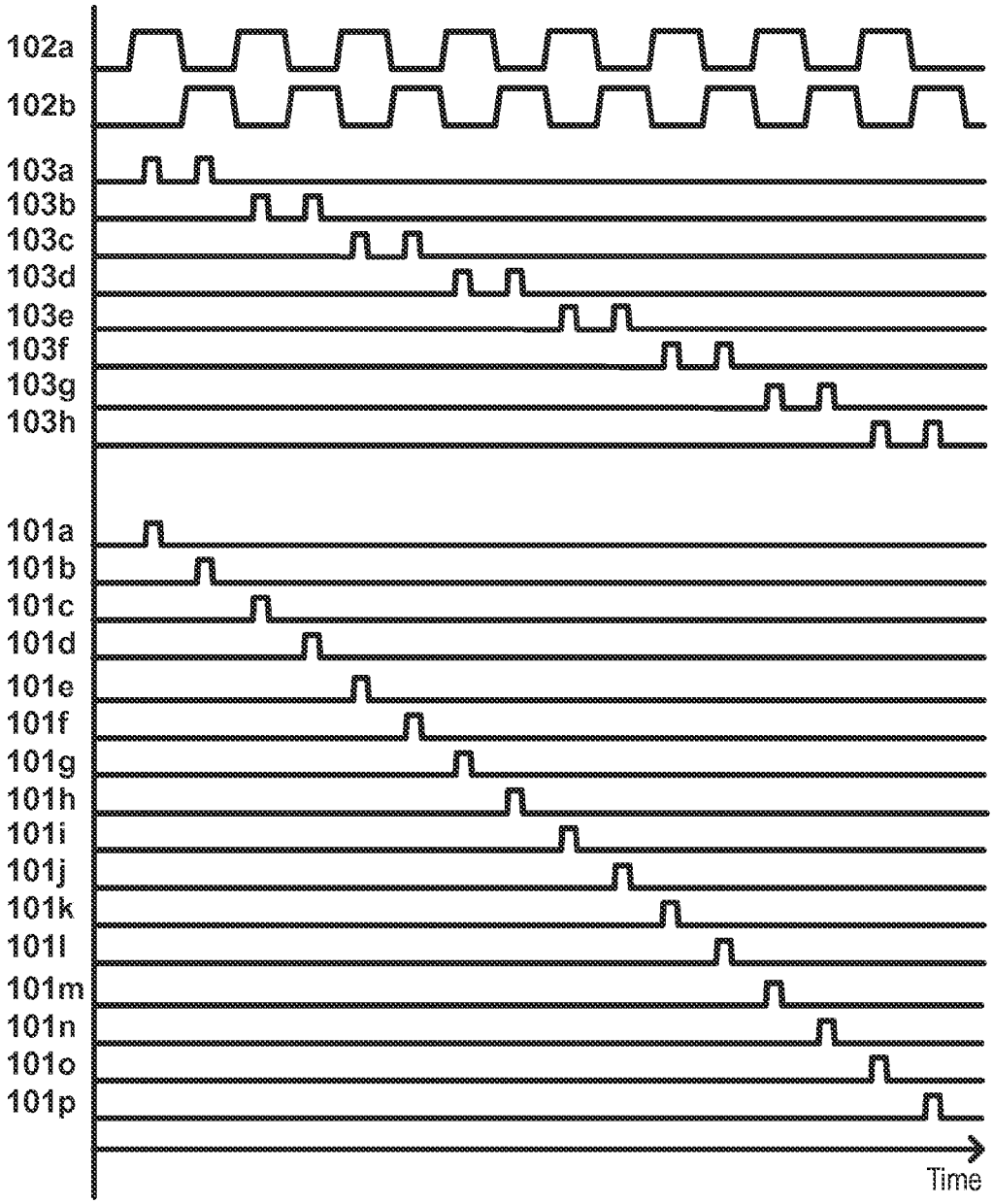
FIG. 4 is a timing chart for explaining the operation of the semiconductor device shown in FIGS. 3A and 3B.

An operation example of the semiconductor devices 310 and 320, particularly, an operation example of the control unit 106 will be explained below with reference to a timing chart shown in FIG. 4. In this operation example, a power supply voltage is supplied to the power supply electrode 104, and a ground voltage is supplied to the ground electrode 105. The abscissa of FIG. 4 represents time. The ordinate of FIG. 4 represents the voltage value of a control signal to be supplied to the gate of each of the first switching elements 102*a* and 102*b* and the second switching elements 103*a* to 103*h*, and represents the value of an electric current which flows through each of the heating elements 101*a* to 101*p*. In the semiconductor device 320, a control signal to be supplied to the first switching element 102*a* is also supplied to the first switching elements 102*c*, 102*e*, and 102*g*, and a control signal to be supplied to the first switching element 102*b* is also supplied to the first switching elements 102*d*, 102*f*, and 102*h*.

The semiconductor devices 310 and 320 supply an electric current to the heating elements 101*a* to 101*p* in this order in the same manner as in the operation of the semiconductor device 100 explained with reference to FIG. 2. The control unit 106 may also generate the control signals shown in FIG. 4 based on signals supplied from outside the semiconductor devices 310 and 320.

The first control unit 106*a* may also sequentially switch the first switching elements 102 to which a High-level control signal is to be supplied, by using a toggle switch. This makes it possible to shorten the driving period of the heating element 101 while holding the output load of the first control unit 106*a* constant. It is also possible to simplify the circuit configuration of the first control unit 106*a* and further downsize the semiconductor device by supplying a common control signal set to each block by the first control unit 106*a*.

Figure 5A:
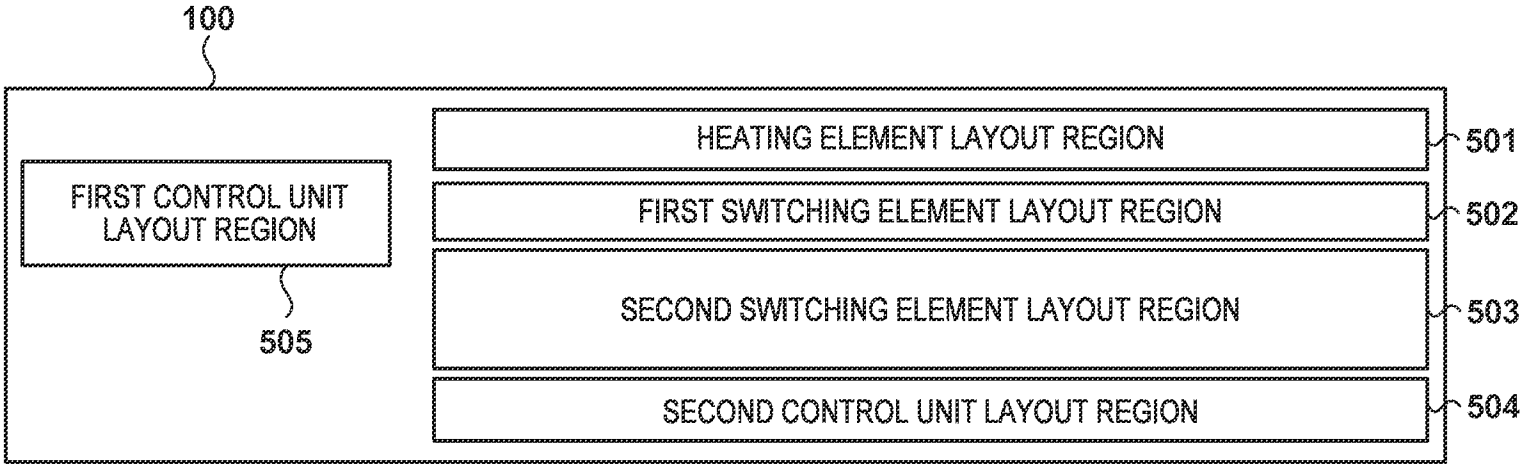
FIGS. 5A to 5C are views showing the layout of constituent elements of a semiconductor device according to some embodiments.

Next, the layout of the individual constituent elements of the semiconductor device 100 will be explained with reference to layout views shown in FIGS. 5A to 5C. The same layouts can be used in the semiconductor devices 310 and 320. As shown in FIG. 5A, the semiconductor device 100 has a rectangular shape which is long sideways. In a heating element layout region 501, the plurality of heating elements 101*a* to 101*d* are laid out in the longitudinal direction. In a first switching element layout region 502, the plurality of first switching elements 102*a* and 102*b* are laid out in the longitudinal direction. In a second switching element layout region 503, the plurality of second switching elements 103*a* and 103*b* are laid out in the longitudinal direction. In a second control unit layout region 504, the second control unit 106*b* is laid out along the plurality of second switching elements 103*a* and 103*b*.

Figure 5B:
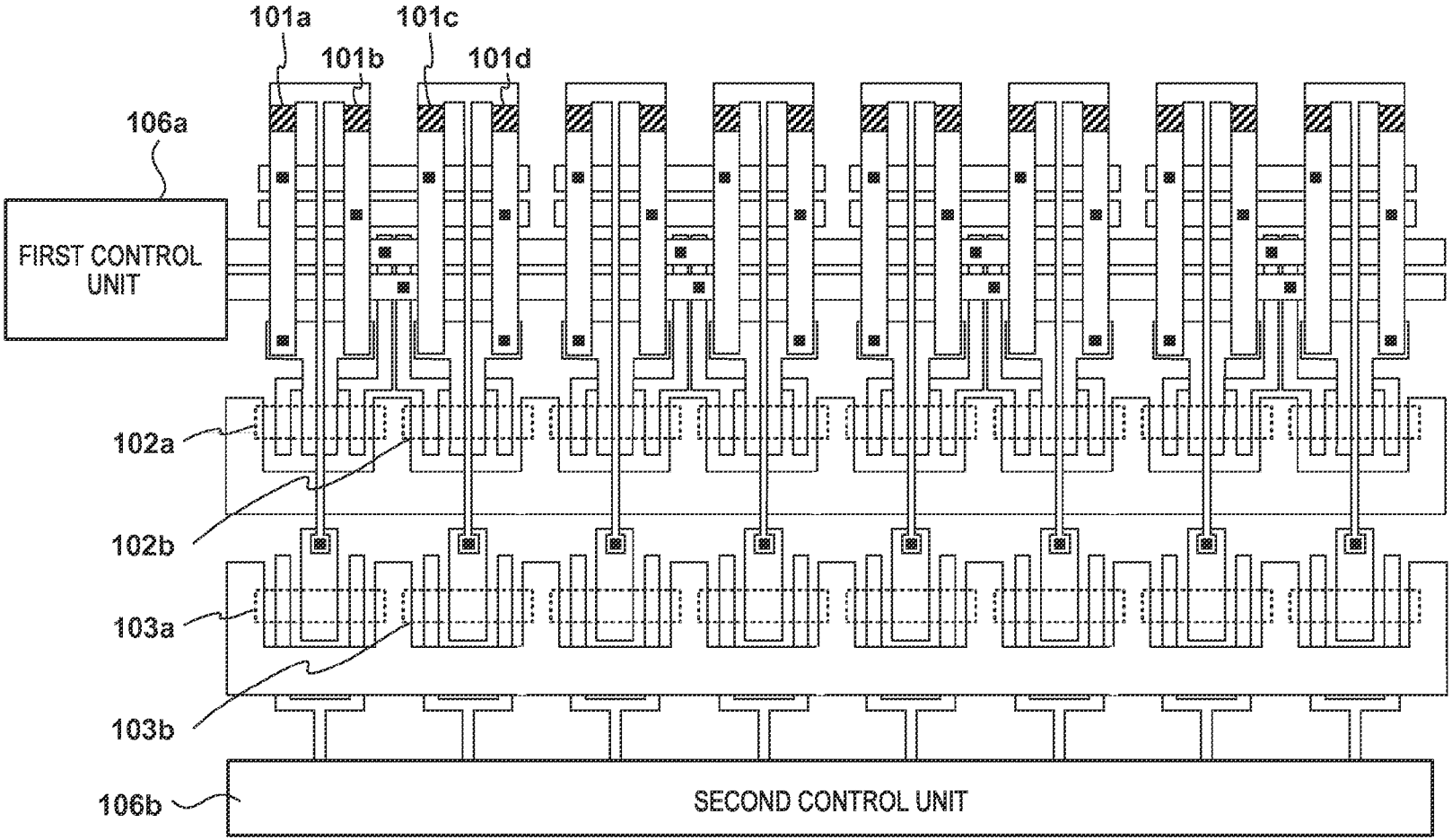

FIG. 5B is a view showing a detailed layout of the heating element layout region, first switching element layout region, and second switching element layout region shown in FIG. 5A. In FIG. 5B, four circuit blocks explained with reference to FIG. 1 are arranged. Sixteen heating elements 101 (indicated by oblique lines) are arranged in a first direction (a horizontal direction in FIG. 5B). Eight first switching elements 102 and eight second switching elements 103 are arranged respectively in the first direction like the heating elements 101. The first and second switching elements 102 and 103 are NMOS transistors, and formed in regions enclosed within dotted lines.

In the example shown in FIG. 5B, interconnection layers are formed by a poly-interconnection forming the gates of transistors and two aluminum interconnections, and connected by contacts (black squares). One terminal of the heating element 101 is connected to the source of the first switching element 102, and the other terminal is connected to the drain of the second switching element 103. The drain of the first switching element 102 is connected to the power supply electrode 104, and the back gate is connected to the source. The source and back gate of the second switching element 103 are grounded. Each first switching element 102 is connected to two heating elements 101. Each second switching element 103 is connected to the other terminal of each of two heaters connected to different first switching elements 102. The first control unit 106*a* supplies a control signal to the gate of the first switching element 102, and the second control unit 106*b* supplies a control signal to the gate of the second switching element 103.

Figure 5C:
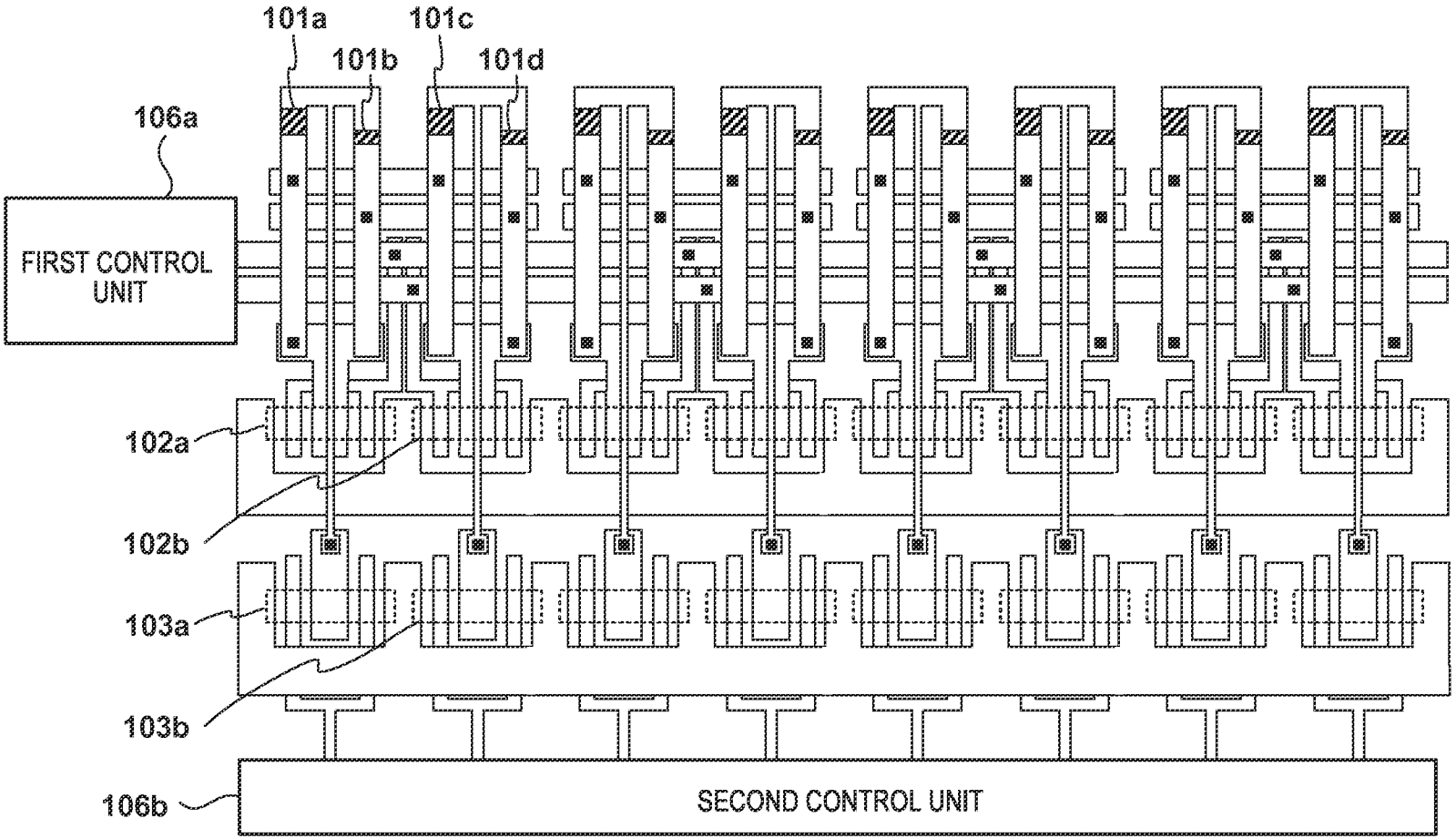

The differences of the example shown in FIG. 5C from the example shown in FIG. 5B are the layout and sizes of the heating elements 101. Referring to FIG. 5C, the heating elements 101 are staggered. Different discharge amounts of ink can be output by making the sizes, resistance values, and positions of even-numbered and odd-numbered heating elements 101 different.

The first control unit 106*a* is laid out in a first control unit layout region 505. As described previously, the first control unit 106*a* includes the level conversion circuit and hence has a circuit configuration more complicated than that of the second control unit 106*b*. Therefore, the first control unit 106*a* is not laid out along the plurality of first switching elements 102*a* and 102*b*, but laid out between the short side of the semiconductor device 100 and the plurality of first switching elements 102*a* and 102*b*. Consequently, the heating elements 101 can densely be laid out. It is also possible to shorten the short side of the semiconductor device 100. When the first control unit 106*a* is laid out in this position, the distance from the first control unit 106*a* to the first switching element 102 becomes longer than that from the second control unit 106*b* to the second switching element 103, and the waveform of a control signal to be supplied to the first switching element 102 breaks. As described earlier, however, an electric current flowing through the heating element 101 is controlled by ON/OFF of the second switching element 103. Accordingly, the break of the waveform of the control signal has no influence on driving of the heating element 101.

The numbers of heating elements 101, first switching elements 102, and second switching elements 103 included in the semiconductor device are not limited to the above-described examples. Generally, when the number of first switching elements 102 is m and the number of second switching elements 103 is n, the control unit 106 can individually drive the heating elements 101, the number of which is equal to or smaller than the product (that is, m×n).

Also, in the above-described example, each of the plurality of first switching elements 102 is connected to a plurality of heating elements 101. However, the plurality of first switching elements 102 may also include one or more first switching elements 102 each connected to two or more heating elements 101, and each of other first switching elements 102 may be connected to one heating element 101. Similarly, the plurality of second switching elements 103 may also include one or more second switching elements 103 each connected to two or more heating elements 101, and each of other second switching elements 103 may be connected to one heating element 101. Thus, even when the semiconductor device includes a switching element connected to only one heating element 101, if the number (that is, m+n) of all switching elements is equal to or less than the number of heating elements 101, the number of switching elements can be made smaller than that of the related art.

Furthermore, in the above-described embodiment, the power supply voltage is supplied to the power supply electrode 104, and the ground voltage is supplied to the ground electrode 105. In general, however, the above-described semiconductor device can operate when different voltages are supplied to the power supply electrode 104 and ground electrode 105.

Figure 6A:
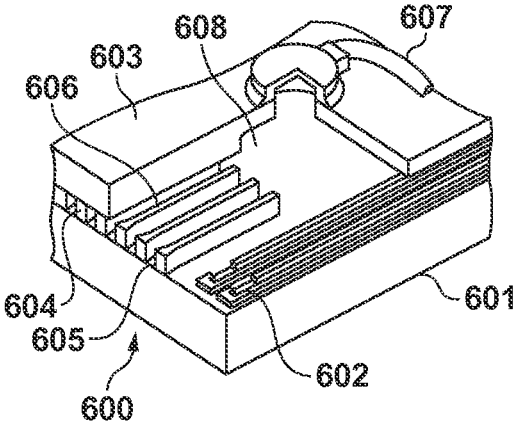
FIGS. 6A to 6D are views for explaining other embodiments.

Next, a liquid discharge head, liquid discharge cartridge, and liquid discharge apparatus using the semiconductor device explained in the above-mentioned embodiment will be explained below with reference to FIGS. 6A to 6D. As an example of the liquid discharge head, FIG. 6A shows the main components of a printhead 600 including the semiconductor device explained in any of the above embodiments as a substrate 601. FIG. 6A depicts the heating element 101 of the above-described embodiment as a heating unit 602. Also, a top plate 603 is partially cut away for the sake of explanation. As shown in FIG. 6A, the printhead 600 can be obtained by combining channel wall members 606 for forming channels 605 communicating with a plurality of orifices 604 and the top plate 603 having an ink supply port 607 to the substrate 601. In this structure, ink injected from the ink supply port 607 is stored in an internal common liquid chamber 608 and supplied to each channel 605, and the substrate 601 is driven in this state. Consequently, the ink is discharged from the orifices 604.

Figure 6B:
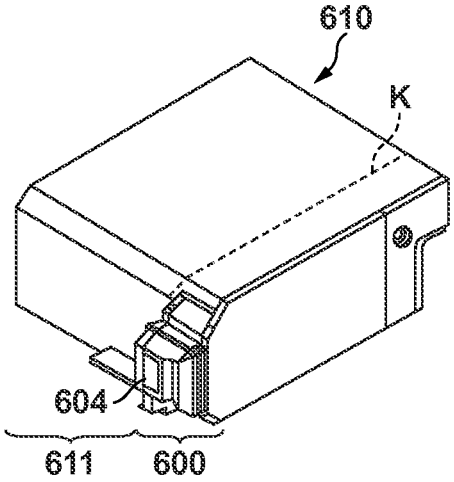

FIG. 6B is a view for explaining the overall configuration of an inkjet cartridge 610 as an example of the liquid discharge cartridge. The cartridge 610 includes the printhead 600 having the plurality of orifices 604 described above, and an ink container 611 containing ink to be supplied to the printhead 600. The ink container 611 as a liquid container is detachable from the printhead 600 from a boundary line K. The cartridge 610 has an electrical contact (not shown) for receiving a driving signal from the carriage side when incorporated into a printing apparatus shown in FIG. 6C, and the heating unit 602 is driven by this driving signal. A fibrous or porous ink absorber for holding ink is formed inside the ink container 611, and holds ink.

Figure 6C:
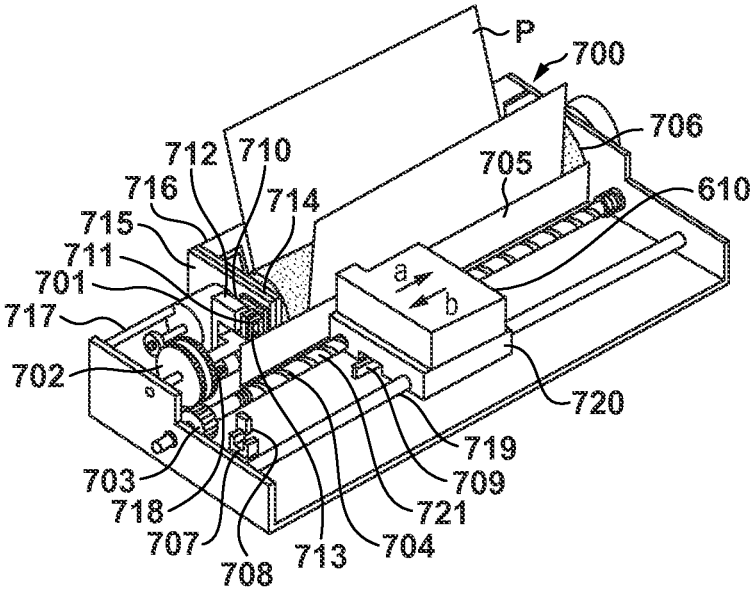

FIG. 6C is an external perspective view of an inkjet printing apparatus 700 as an example of the liquid discharge apparatus. An inkjet printing apparatus 700 incorporates a cartridge 610, and can implement high-speed printing and high-image-quality printing by controlling signals to be supplied to the cartridge 610. In the inkjet printing apparatus 700, the cartridge 610 is mounted on a carriage 720 which engages with a spiral groove 721 of a lead screw 704 which rotates via driving force transmission gears 702 and 703 in synchronism with the forward/reverse rotation of a driving motor 701. The cartridge 610 can move together with the carriage 720 forward and backward in the direction of an arrow a or b along a guide 719 by the driving force of the driving motor 701. A paper pressing plate 705 for printing paper P conveyed onto a platen 706 by a printing medium feeding device (not shown) presses the printing paper P against the platen 706 along the carriage moving direction. Photocouplers 707 and 708 check the existence of a lever 709 of the carriage 720 in a region where the photocouplers 707 and 708 are arranged, and detect a home position in order to, for example, switch the rotating directions of the driving motor 701. A support member 710 supports a cap member 711 which caps the entire surface of the cartridge 610. A suction unit 712 performs suction in the cap member 711, thereby performing suction recovery of the cartridge 610 through a cap opening. A moving member 715 makes a cleaning blade 714 movable back and forth, and the cleaning blade 714 and moving member 715 are supported by a body support plate 716. The cleaning blade 714 is not limited to the form shown in FIG. 6C, and a well-known cleaning blade is also applicable to this embodiment. In addition, a lever 717 is formed to start suction of the suction recovery. The lever 717 moves along with the movement of a cam 718 which engages with the carriage 720, and the movement is controlled by a well-known transmission method such as clutch switching of the driving force from the driving motor 701. A printing control unit (not shown) which supplies signals to the heating unit 602 formed in the cartridge 610 and controls the driving of each mechanism such as the driving motor 701 is formed in the apparatus main body.

Figure 6D:
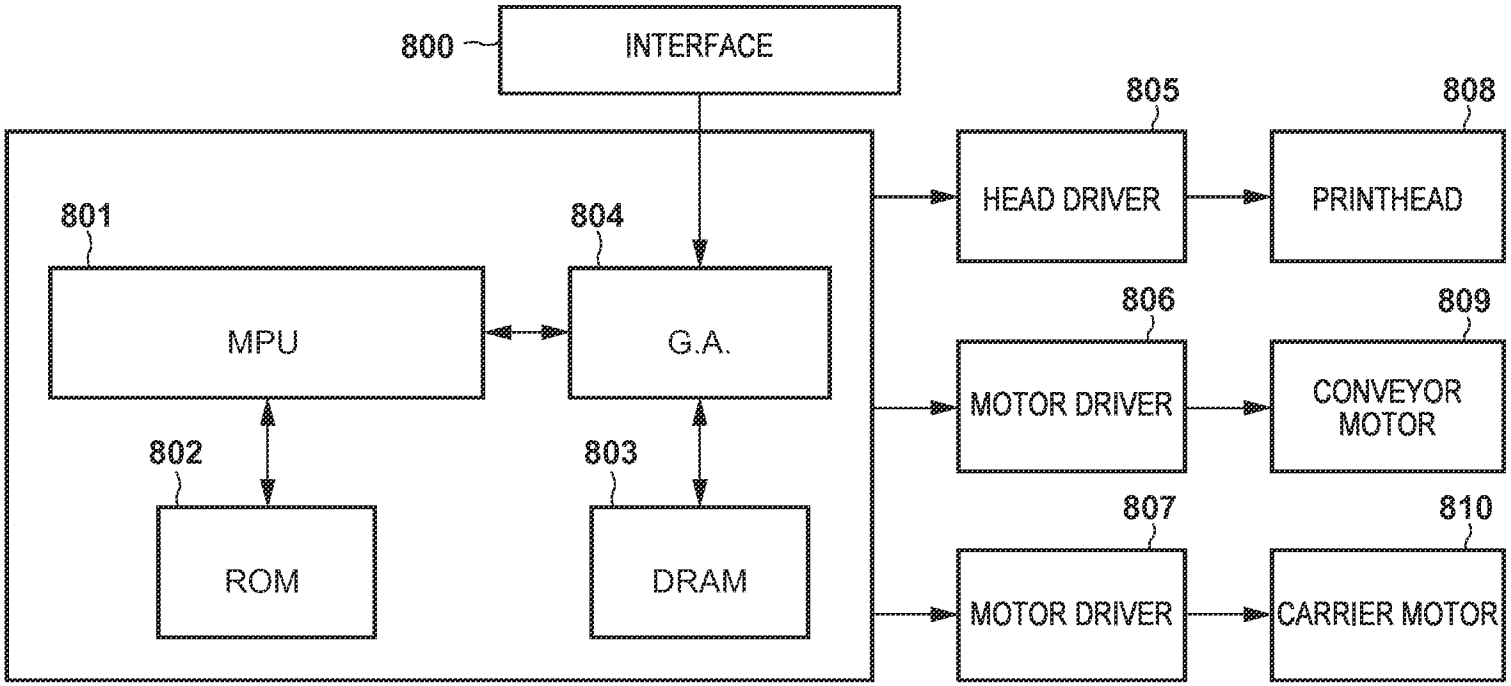

The configuration of a control circuit for executing printing control of the inkjet printing apparatus 700 will now be explained with reference to a block diagram shown in FIG. 6D. This control circuit includes an interface 800 which receives a printing signal, an MPU (Micro Processor) 801, and a program ROM 802 storing a control program to be executed by the MPU 801. The control circuit further includes a dynamic RAM (Random Access Memory) 803 for saving various kinds of data (for example, the above-mentioned printing signal and printing data to be supplied to a head), and a gate array 804 for controlling supply of printing data to a printhead 808. The gate array 804 also controls data transfer between the interface 800, MPU 801, and RAM 803. In addition, this control circuit includes a carrier motor 810 for conveying the printhead 808, and a conveyor motor 809 for conveying printing paper. Furthermore, this control circuit includes a head driver 805 for driving the printhead 808, and motor drivers 806 and 807 for respectively driving the conveyor motor 809 and carrier motor 810. The operation of the above-mentioned control configuration will be explained below. When a printing signal is input to the interface 800, this printing signal is converted into a printing data for printing between the gate array 804 and MPU 801. Then, the motor drivers 806 and 807 are driven, and the printhead is driven in accordance with the printing data supplied to the head driver 805.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2014-076461, filed Apr. 2, 2014 and 2014-245172, filed Dec. 3, 2014, which are hereby incorporated by reference herein in their entirety.

What is claimed is:

1. A semiconductor device for a liquid discharge head, comprising:

a first electrode configured to supply a first voltage;

a second electrode configured to supply a second voltage different from the first voltage;

a plurality of discharge elements configured to impart energy to a liquid, each discharge element including a first terminal and a second terminal;

a plurality of first switching elements configured to electrically connect the first terminals of the plurality of discharge elements to the first electrode, and including one or more first switching elements each connected to two or more discharge elements among the plurality of discharge elements; and a plurality of second switching elements configured to electrically connect the second terminals of the plurality of discharge elements to the second electrode, and including one or more second switching element each connected to two or more discharge elements among the plurality of discharge elements, wherein two or more discharge elements connected to a same second switching element, among the plurality of discharge elements are connected to different first switching elements among the plurality of first switching elements, wherein the number of the plurality of first switching elements is smaller than that of the plurality of second switching elements, wherein the plurality of discharge elements are arranged in a direction, wherein the plurality of first switching elements are arranged in the direction, and wherein the plurality of second switching elements are arranged in the direction.

2. The device according to claim 1, wherein two or more discharge elements connected to the same second switching element are arranged adjacent to each other.

3. The device according to claim 1, further comprising a control unit configured to control the plurality of first switching elements and the plurality of second switching elements, wherein the control unit drives one of the plurality of discharge elements by turning on a first switching element and a second switching element both connected to the one discharge element.

4. The device according to claim 3, wherein the control unit switches ON/OFF of a second switching element connected to one of the plurality of discharge elements, in a state in which a first switching element connected to the one discharge element is ON.

5. The device according to claim 3, wherein the control unit synchronously controls two or more first switching elements connected to two or more discharge elements connected to different second switching elements.

6. The device according to claim 3, wherein the control unit includes a first control unit configured to control the plurality of first switching elements, and a second control unit configured to control the plurality of second switching elements, and the second control unit is arranged along the plurality of second switching elements.

7. The device according to claim 6, wherein the semiconductor device has a rectangular shape, the direction in which the plurality of first switching elements are arranged is a longitudinal direction of the semiconductor device, and the first control unit is arranged between a short side of the semiconductor device and the plurality of first switching elements.

8. The device according to claim 1, wherein the second voltage is lower than the first voltage.

9. The device according to claim 1, wherein the first voltage is a power supply voltage, and the second voltage is a ground voltage.

10. The device according to claim 1, wherein the plurality of discharge elements and the plurality of second switching elements are in a block, and wherein the device comprises a plurality of the blocks.

11. The device according to claim 10, wherein the block comprises the plurality of first switching elements.

12. A liquid discharge head comprising a semiconductor device cited in claim 1, and an orifice configured to discharge a liquid under control of the semiconductor device.

13. A liquid discharge cartridge comprising a liquid discharge head cited in claim 12, and a liquid container configured to contain ink.

14. A liquid discharge apparatus comprising a liquid discharge head cited in claim 12, and a supply unit configured to supply a driving signal for causing the liquid discharge head to discharge a liquid.

15. A semiconductor device for a liquid discharge head, comprising:

a first electrode configured to supply a first voltage;

a second electrode configured to supply a second voltage different from the first voltage;

a plurality of discharge elements configured to impart energy to a liquid, each discharge element including a first terminal and a second terminal;

a plurality of first switching elements configured to electrically connect the first terminals of the plurality of discharge elements to the first electrode, and including one or more first switching elements each connected to two or more discharge elements among the plurality of discharge elements; and a plurality of second switching elements configured to electrically connect the second terminals of the plurality of discharge elements to the second electrode, and including one or more second switching element each connected to two or more discharge elements among the plurality of discharge elements, wherein two or more discharge elements connected to a same second switching element, among the plurality of discharge elements are connected to different first switching elements, wherein the number of the plurality of first switching elements is smaller than that of the plurality of second switching elements, and wherein the two or more discharge elements connected to the same second switching element are arranged adjacent to each other.

16. The device according to claim 15, wherein the plurality of discharge elements, the plurality of first switching elements, and the plurality of second switching elements are included in a block, and wherein the device comprises a plurality of the blocks.

17. A semiconductor device for a liquid discharge head, comprising:

a first electrode configured to supply a first voltage;

a second electrode configured to supply a second voltage different from the first voltage;

a plurality of discharge elements configured to impart energy to a liquid, each discharge element including a first terminal and a second terminal;

a plurality of first switching elements configured to electrically connect the first terminals of the plurality of discharge elements to the first electrode, and including one or more first switching elements each connected to two or more discharge elements among the plurality of discharge elements;

a plurality of second switching elements configured to electrically connect the second terminals of the plurality of discharge elements to the second electrode, and including one or more second switching element each connected to two or more discharge elements among the plurality of discharge elements; and a control unit configured to control the plurality of first switching elements and the plurality of second switching elements, wherein two or more discharge elements connected to a same second switching element, among the plurality of discharge elements are connected to different first switching elements, wherein the number of the plurality of first switching elements is smaller than that of the plurality of second switching elements, and wherein the control unit switches ON/OFF of a second switching element connected to one of the plurality of discharge elements, among the plurality of second switching elements, in a state in which a first switching element connected to the one discharge element, among the plurality of first switching elements is ON.

18. The device according to claim 17, wherein the plurality of discharge elements, the plurality of first switching elements, and the plurality of second switching elements are included in a block, and wherein the device comprises a plurality of the blocks.

* * * * *